US005317949A

United States Patent [19]

Sugg

[11] Patent Number: 5,317,949

[45] Date of Patent: Jun. 7, 1994

[54] FIRING MECHANISM FOR BREECH-LOADING WEAPONS

[76] Inventor: Ronald E. Sugg, 7800 Castlecomb Rd., Knoxville, Tenn. 37849

[21] Appl. No.: 45,810

[22] Filed: Apr. 9, 1993

[51] Int. Cl.[5] ..... F41A 3/10

[52] U.S. Cl. ..... 89/24; 89/27.11

[58] Field of Search ..... 42/23, 24, 69.01; 89/1.705, 24, 27.11

[56] References Cited

U.S. PATENT DOCUMENTS

| | | | |
|---|---|---|---|
| 458,505 | 8/1891 | Skodd | 89/24 |
| 459,828 | 9/1891 | Maxim | 89/24 |
| 466,567 | 1/1892 | Koerner | 89/24 |
| 512,743 | 1/1894 | Parkhurst | 89/24 |
| 1,040,001 | 10/1912 | Olsson | 89/24 |
| 1,707,444 | 4/1929 | McCann | 89/24 |
| 2,802,400 | 8/1957 | Edmund | 89/24 |
| 2,821,885 | 2/1958 | Burk | 89/24 |
| 3,687,001 | 8/1972 | Brint | 89/24 |
| 5,042,361 | 8/1991 | Janssen et al. | 89/24 |

FOREIGN PATENT DOCUMENTS

| | | | |
|---|---|---|---|
| 452681 | 11/1927 | Fed. Rep. of Germany | 89/27.11 |

OTHER PUBLICATIONS

Webster's II New Riverside University Dictionary, "breech", 1984, p. 200.

*Primary Examiner*—Stephen C. Bentley
*Attorney, Agent, or Firm*—Pitts & Brittian

[57] ABSTRACT

A firing mechanism for a breech-loaded weapon to assure safety and provide reliability of operation. A receiver is formed from a central portion that has a receptor whereby the mechanism can be assembled to the rear end of a weapon barrel, there being a pair of yoke legs extending rearward from this central portion. Each of the yoke legs have slideways to receive a closely dimensioned breech block. The breech block is moved in a reciprocating motion, when desired, by action of a lever. A shaft attached to this lever causes operation of linkage members which, in turn, move the breech block from a fully caged position within the yoke arm slideways to a shell-loading position. During this motion a hammer assembly is moved to a cocked position and an ejector removes any spent shell from the weapon. A trigger release extension pin in the breech block is aligned with a trigger release pin in the receiver only when the breech block is fully caged in the receiver thereby preventing firing until this fully caged position is achieved. Provision is made for the disassembly of components of the mechanism without the use of tools, thereby facilitating "field stripping" of the mechanism.

18 Claims, 4 Drawing Sheets

FIRING MECHANISM FOR BREECH-LOADING WEAPONS

TECHNICAL FIELD

This invention relates to the field of firearms. More particularly, it relates to a firing mechanism for a breech-loaded weapon.

BACKGROUND ART

In recent years, the popularity of the 0.50 BMG cartridge has risen among hobbyists, the para-military, as well as in various branches of the armed forces. What is needed is a firing mechanism for a breech-loaded weapon that can be adapted to heavy caliber rifles and/or shoulder-fired cannon chambered for the 0.50 BMG, the 14.5 mm Russian cartridge, the 20 mm Vulcan round and similar large cartridges. A recoil dampening device for large caliber weapons that would allow a shouldered-fired configuration for a weapon chambered for the 0.50 BMG, the 14.5 mm Russian cartridge, the 20 mm Vulcan round and similar large cartridges is shown and described in my co-pending application, Ser. No. 08/031,961, filed on Mar. 16, 1993, which is hereby incorporated by reference.

Due to the popularity of the 0.50 BMG cartridge among hobbyists, the para-military, as well as various branches of the armed forces, it is also desirable to have a fully caged firing mechanism that has a high degree of safety, i.e. one not capable of firing a cartridge prior to the cartridge being chambered and the mechanism fully closed and locked, and that can be readily field stripped, cleaned and reassembled by hand without the use of tools.

U.S. Pat. No. 458,505, issued to Emil Ritter Von Skoda on Aug. 25, 1891, discloses a sliding breech-block firing mechanism such as was commonly used on artillery. Von Skoda's firing mechanism slides within guide grooves and is designed to bring the firing pin to a cocked position through the movements of the breech block. However, in Von Skoda's firing mechanism, the sear that releases firing pin is in constant engagement with the trigger release thus presenting the possibility of chambering a round and sliding the breech-chamber closed without actually cocking the firing pin. Because Von Skoda's firing mechanism slides within guide grooves, it is not likely that the Von Skoda firing mechanism could easily, or safely, be adapted to a shoulder-fired rifle chambered for the 0.50 BMG, the 14.5 Russian cartridge or the 20 mm Vulcan round. What is needed is a breech-block that can be fully caged in mortise-tenon manner and that prevents engagement of the sear by the trigger release prior to the point where the breech-block is closed.

The following references are also noted as relating to breech-loading mechanisms; U.S. Pat. No. 466,567 issued to Koerner on Jan. 5, 1892; U.S. Pat. No. 512,743 issued to Parkhurst on Jan. 16, 1894; U.S. Pat. No. 1,040,001 issued to Olsson on Oct. 1, 1912; U.S. Pat. No. 1,707,444 issued to McCann on Apr. 2, 1929; U.S. Pat. No. 2,802,400 issued to Edmund on Aug. 13, 1957; U.S. Pat. No. 2,821,885 issued to Burk on Feb. 4, 1958; U.S. Pat. No. 3,687,001 issued to Brint on Aug. 29, 1972; and U.S. Pat. No. 5,042,361.

Accordingly, it is an object of this invention to provide a firing mechanism for breech-loaded weapons wherein the firing mechanism is fully caged, self-contained within the breech block, and automatically cocked upon cycling the action.

It is also an object of the present invention to provide a firing mechanism that moves within the breech-block in a mortise and tenon configuration.

A further object of the present invention is to provide a breech-loaded firing mechanism in which the sear assembly is not engaged by the trigger release until the breech is closed by firing mechanism and the firing mechanism is fully caged.

Still another object of the present invention is to provide a firing mechanism that is machined with very close tolerances and interlocking components that allow the firing mechanism to be completely stripped, cleaned and reassembled by hand without the use of tools.

These and other objects and advantages over the prior art will become apparent to those skilled in the art upon reading the detailed description together with the drawings as described as follows.

DISCLOSURE OF THE INVENTION

In accordance with the present invention, there is provided a firing mechanism for the attachment to a barrel of a breech-loaded rifle or similar weapon. A receiver is adapted to be received at the rear end of the weapon barrel and to receive a breech block. The receiver has a central portion from which extend two apertured leg members, with the breech block being slidably received in these apertured leg members in the form of a mortise and tenon. In the preferred form of the invention the breech block moves generally in horizontal sliding motion. A lever pivotally supported in the receiver, and engaged with members within the breech block, produce this axial sliding motion of the breech block. Near the extremity of travel of the lever during removal of the breech block, the lever engages an ejector mechanism causing an ejector to remove any spent shell from the weapon. Further, as the breech block is moved from a fully caged position within the receiver to an extended position, a hammer assembly is moved to a cocked condition. A trigger release carried by the receiver is positioned such that only when the firing pin is centered relative to a shell in the rifle can the hammer be moved from the cocked position to the fired position against the firing pin. Components are manufactured to close tolerances and interlock such that no independent fastening elements, i.e. screws or drive pins, are utilized. Thus, the present device can be "field stripped" without the use of tools.

BEST MODE FOR CARRYING OUT THE INVENTION

Figure 1:
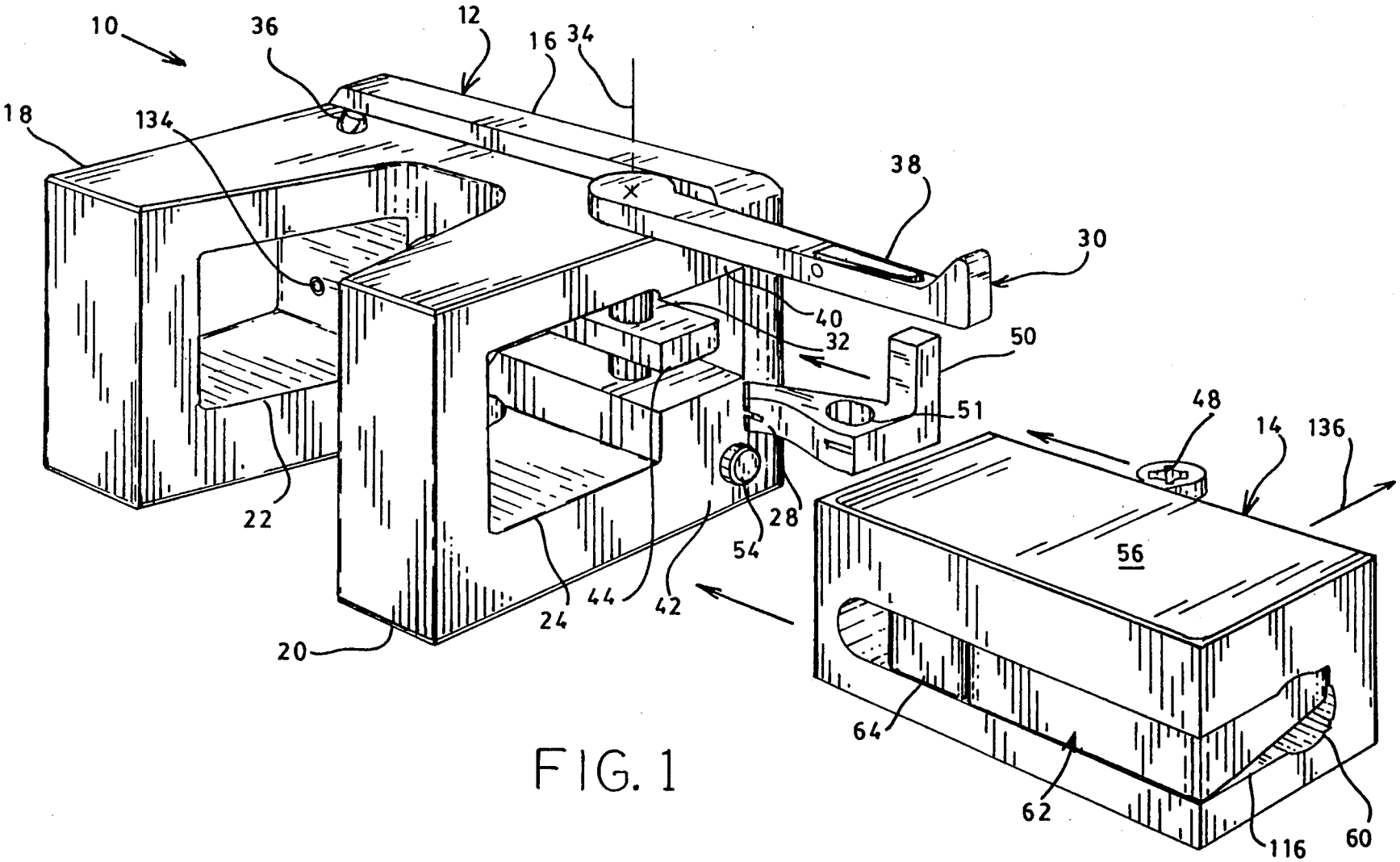
FIG. 1 is a perspective drawing illustrating a firing mechanism according to the present invention, with a portion thereof disassembled for ease of showing certain components thereof.

The present invention is shown generally at 10 in FIG. 1, a perspective drawing of the device with certain parts "exploded" relative to others so as to better show the construction. The devise 10 has two primary components, a receiver 12 and a breech block 14 that is slidably received in the receiver 12. The receiver 12 is generally U-shaped, with a central portion 16 and a pair of yoke legs 18, 20 extending rearwardly from the central portion. Each of the yoke legs 18, 20 are apertured as at 22, 24, respectively, so as to closely receive the breech block 14 in the form of a mortise and tenon configuration. In the preferred embodiment, the receiver 12 is arranged such that the breech block 14 moves in a horizontal plane.

Figure 2:
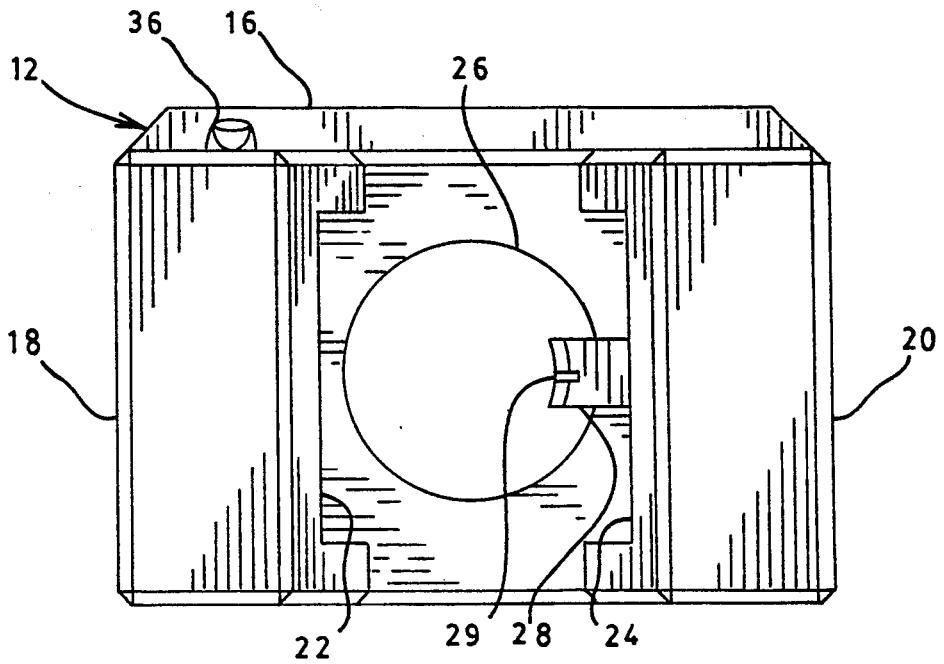
FIG. 2 is a rear elevation of the receiver of the firing mechanism of FIG. 1 illustrating the receptor thereof for engagement with a barrel of a rifle with a spent shell ejector shown as projecting inwardly from the edge of this receptor.

A rear elevation of the receiver 12 is shown in FIG. 2. This receiver 12 being provided with a receptor 26 for threadable engagement with the end of a weapon barrel (not shown, but such as illustrated in the aforementioned patent application Ser. No. 08/031,961). Also, shown is an ejector 28, whose operation is described hereinafter, that projects outwardly from the receiver 12 to engage a weapon shell (not shown) during insertion thereof into a barrel of the weapon, and then eject the spent shell after firing and during axial movement of the breech block 14. This ejector 28 has a groove 29 such that a firing pin within the breech block 14 can pass.

Referring again to FIG. 1, additional construction and features of the present invention are illustrated. An operating lever 30, attached to a lever shaft 32, is carried by the receiver 12 and can be rotated around an axis indicated at 34. The lever shaft 32 extends from above the receiver 12 for receiving the operating lever 30, to proximate the bottom of the receiver 12 (see FIG. 5). The operating lever 30 is shown in a fully rotated position in this FIG. 1; when rotated in the opposite direction, the operating lever 30 engages a lever latch 36 which typically is a spring-loaded detent. A latch release 38 positioned in the operating lever 30 brings about disengagement of the operating lever 30 from the latch 36.

Figure 5:
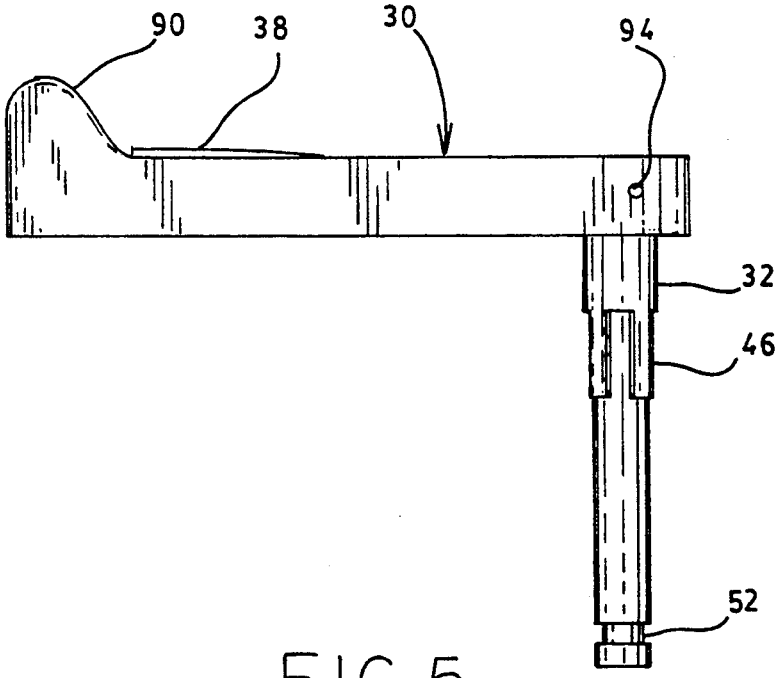
FIG. 5 is a side elevation of a lever mechanism for engagement with both the receiver of FIGS. 1 and 2 and the breech block of FIGS. 1 and 3, the lever mechanism providing for movement of the receiver, the cocking of a hammer, and the operation of the ejector for removing spent shells.

The lever shaft 32 passes through upper and lower portions 40, 42, as well as an intermediate support 44, of the central portion 16 of the receiver 42. Although not shown in this figure (but see FIG. 5), the lever shaft 32 has a splined portion 46 that engages a first end of a drive link 48 when this drive link 48 is interposed between receiver portions 40 and 44. Further, the lever shaft 32 passes through an ejector operator 50, carrying the aforementioned ejector 28, forming the pivot therefor when the ejector operator 50 is interposed between receiver portions 42 and 44. This ejector operator 50 has an elongated through-hole 51 and is biased toward one edge of this through-hole 51 by a spring (not shown) to permit the ejector 28 to move during the insertion of a shell into the weapon. As illustrated in FIG. 5, a detent engaged with recess 52 on the lever shaft 32 normally limits axial movement of the lever shaft 32. When axial movement is desired, a shaft release 54 provided on the receiver 12 is operated.

Figure 4:
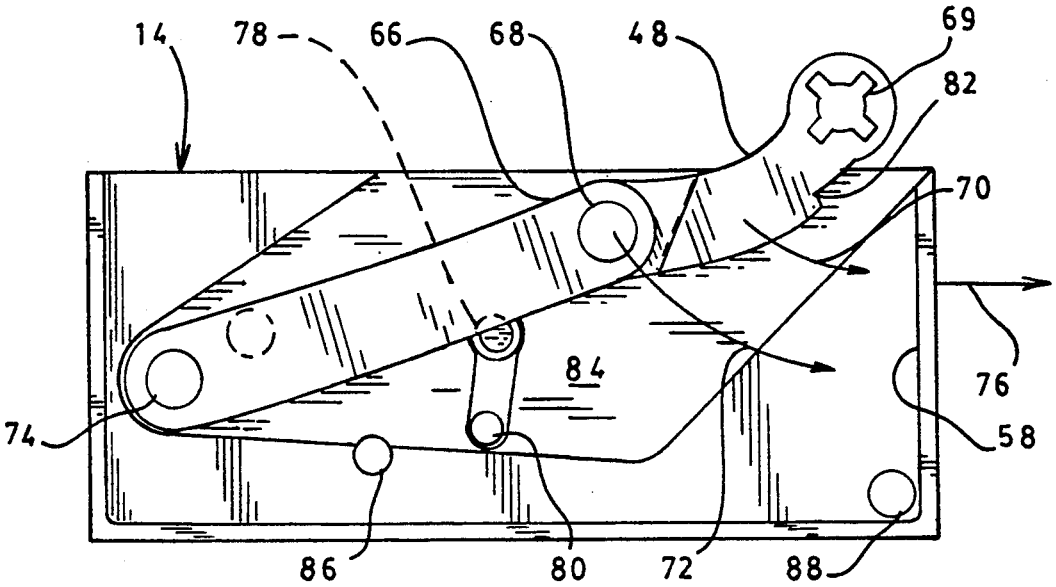
FIG. 4 is a top view of the breech block of FIG. 3 with the dust cover removed, illustrating the mechanism for movement of the breech block into and out of the receiver of FIGS. 1 and 2.

FIG. 1 illustrates portions of the breech block not clearly shown in other block 14, as shown in FIG. 4, are protected from the elements with a dust cover 56 that, can be moved in a keyway 58. Further, the breech block 14 has a hammer spring receptor 60, as further shown in FIGS. 6 and 7. This view also shows the external surface of a hammer assembly 62, and a primary sear 64 that is involved in the cocking and release of the hammer of hammer assembly 62.

Figure 3:
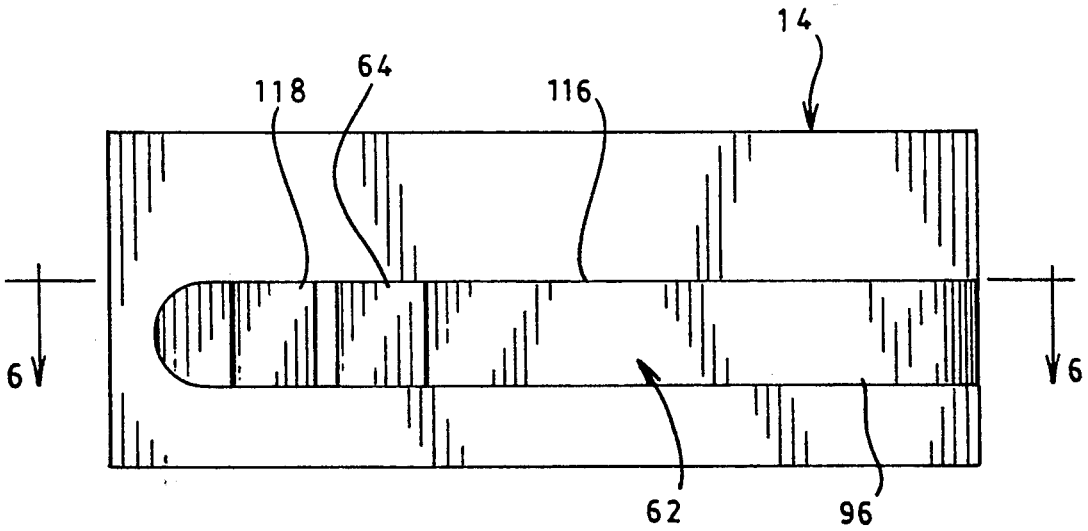
FIG. 3 is the rear elevation of a breech block of the firing mechanism of FIG. 1 that is normally received in the receiver of FIG. 2.
Figure 6:
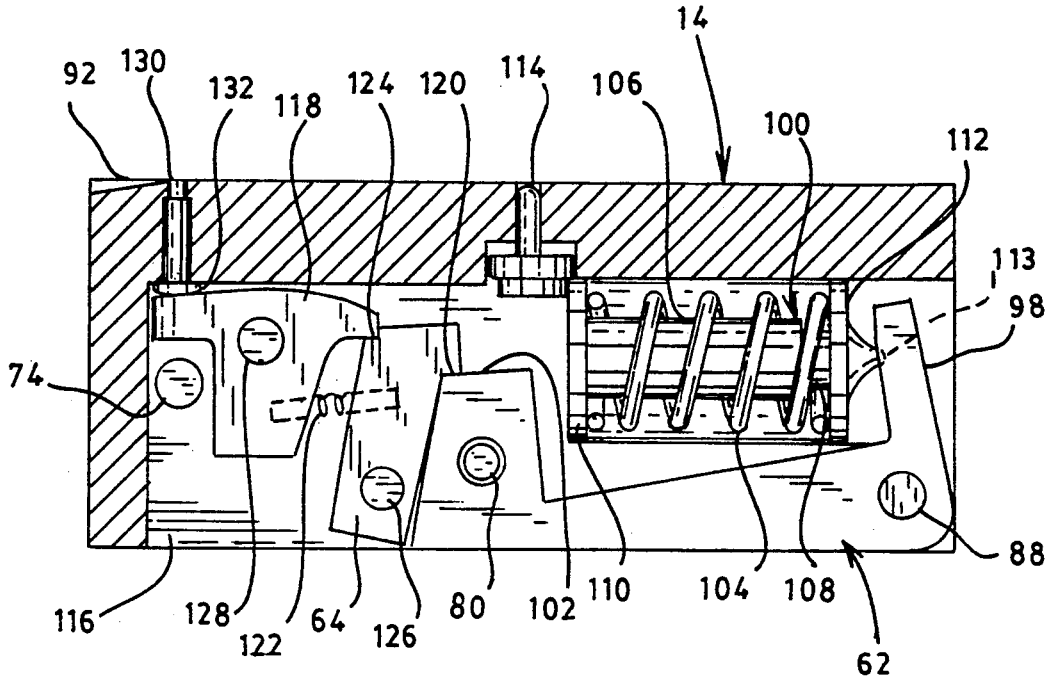
FIG. 6 is a cross-sectional view of the breech block of FIGS. 1 and 3, taken at 6—6 of FIG. 3, illustrating the hammer assembly in a cocked position relative to a firing pin.
Figure 7:
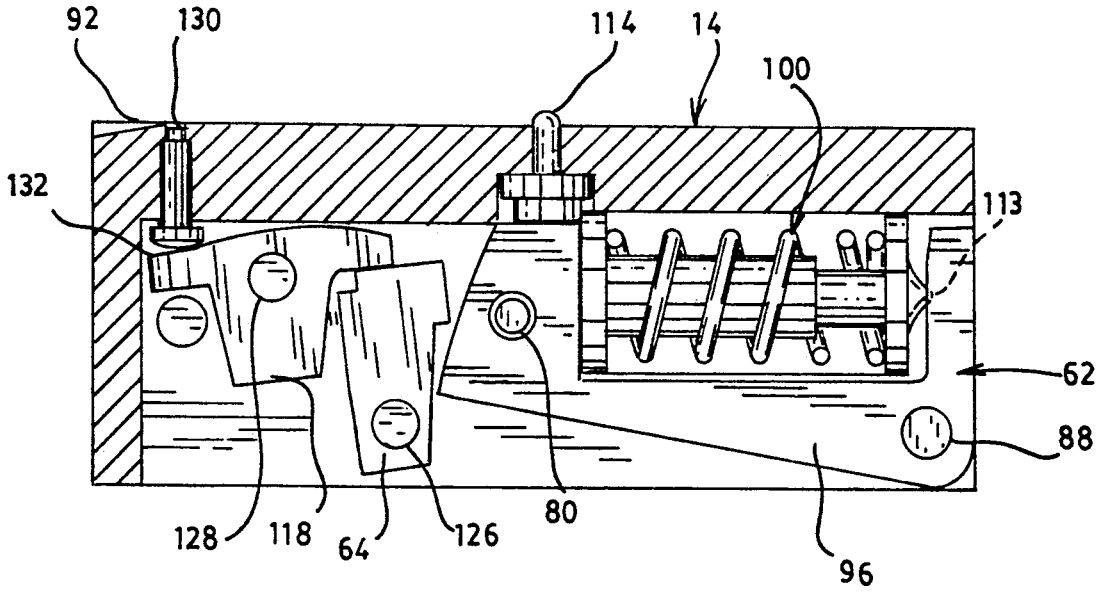
FIG. 7 is a cross-sectional view, also taken at 6—6 of FIG. 3, illustrating the hammer assembly in a fired position relative to the firing pin.

FIG. 3 illustrates the rear face of the breech block 14. It can be seen that the hammer assembly 62, with the hammer arm 96 shown, fits within a hammer slot 116. Also contained in this slot 116 are the primary sear 64 and a secondary sear 118 (see FIGS. 6 and 7). The cross-sections shown in these FIGS. 6 and 7 are taken at 6—6 of this FIG. 3.

Operation of the present invention during axial movement of the breech block 14 can be best understood by referring to FIG. 4. In this figure, the afore-mentioned dust cover 56 is removed. This drawing shows the position of components when the breech block 14 is fully caged in the receiver 12. In this position the afore-mentioned drive link 48 and a drag link 66 are substantially aligned, with these links 48 and 66 joined by a pivot 68. As the operator lever 30 (see FIGS. 1 and 4) is rotated around the axis 34, splines 46 on the lever shaft 32 engaged in a spline receptor 69 of the drive link 48 cause rotation in a direction indicated by the arrow 70, thus causing the pivot pin 68 joining the drive link 48 to the drag link 66 to be moved in a direction indicated by the arrow 72. Since a distal end of the drag link 66 is pivotally attached to the breech block 14 at pivot 74, the breech block 14 is caused to move in the direction indicated with the arrow 76. As this motion occurs, a recess 78 in the drag link 66 engages a hammer cocking pin 80 causing the hammer assembly 62 to be moved to a cocked position (see FIG. 6). In addition, as a full rotation of the operator lever 30 is completed, a shoulder 82 on the drive link 48 engages the afore-mentioned ejector operator 50 causing rotation thereof. Since this is pivoted on the lever shaft 32, the ejector 28 causes ejection of a spent shell from the weapon. It will be recognized that then the operation lever is rotated in an opposite direction around the axis 34, these elements are moved in an opposite direction to move the breech block 14 into a caged position within the receiver 12.

The drive link 48 and the drag link 66 move in a recess 84 within the breech block 14 just beneath the dust cover 56. Further illustrated in this FIG. 4 is a dust cover detent 86 to retain the dust cover 56 in a closed position, and a pivot pin 88 for the hammer assembly 62 (see also FIGS. 6 and 7).

Referring now to FIG. 5, shown therein is a side elevation of the operating lever 30 and the lever shaft 32. It can be seen that the distal end 90 of the lever 30 is broadened so as to provide a grip for a user of the device. The release 38 for the lever 30 is positioned near this distal end 90 to facilitate operation thereof. The shaft 32 has cylindrical shapes where it passes through components for which it serves as a pivot. Further, there is a splined section 46 that engages the splined receptor 69 of the drive link 48. Proximate the distal end of the shaft 32 is a recess 52 into which a detent (not shown) is received to prevent inadvertent removal of the lever shaft 32 from the assembly. However, the release 54 illustrated in FIG. 1 can be operated to release the detent, allowing withdrawal of the lever shaft 32 when the disassembly is desired. If desired, a pin 94 holds the lever shaft 32 in proper relationship to the lever 30. Of course, other locking means can be used in place of the pin 94.

The cocking of the hammer assembly 62 can be understood by referring to FIG. 6. This hammer assembly 62 essentially includes a hammer arm 96, a hammer spring arm 98, a hammer spring assembly 100, a hammer 102 and the afore-mentioned hammer assembly pivot 88 and the afore-mentioned hammer cocking pin 80. In the embodiment illustrated, the hammer spring assembly 100 includes a spring 104 positioned concentrically around telescoping tubes 106, 108. Flange 110 on tube 106 bears against the inner end of the hammer spring receptor 60, and a slight protrusion in the center of flange 112 On tube 108 bears against a locating detent 113 in the hammer spring arm 98. The components other than the spring assembly 100, are generally positioned within a slot 116 of the breech block 14. This configuration of the hammer enveloping the hammer spring permits a much more compact assembly than conventional components which are normally arranged in a linear or circular fashion.

Cocking of the hammer assembly 62 to remove the hammer 102 from a firing pin 114 is accomplished by the action of a primary sear 64 and a secondary sear 118. When the hammer cocking pin 80 is moved into the position shown (as by action of the drag link 66 of FIG. 4), a shoulder 120 on the primary sear 64 is moved to engage a top end of the hammer 102 by action of a sear spring 122 positioned between the secondary sear 118 and the primary sear 64. At the same time, a first shoulder 124 of the secondary sear 118 engages an edge of the primary sear 64, as shown. These pivotal motions occur around pivot pin 126 (which can be an extension of the afore-mentioned dust cover detent 86) and pivot pin 128. This dual sear arrangement permits a very strong hammer spring to be utilized, thereby compacting a large amount of hammer energy within a smaller space than is conventionally used. The primary sear 64 has a negative tangent engagement with the hammer, retaining over one hundred pounds of hammer energy with a rotational resistance at only fifteen pounds. This resistance is supplied by the secondary sear 118. This FIG. 6 shows a trigger release pin extension 130 that abuts a further shoulder 132 of the secondary sear 118. This trigger release pin extension 130 is aligned with a trigger release pin 134 in the receiver 12 (see FIG. 1) only when the breech block 14 is fully caged in the receiver 12.

The positions of these same components when firing occurs is illustrated in FIG. 7. Axial motion of the trigger release pin extension 130 against shoulder 132, through axial motion of the trigger release pin 134, rotates the secondary sear 118 sufficiently such that shoulder 124 is disengaged from the primary sear 64. Under this condition, force of the hammer assembly spring 104 causes rotation of the primary sear 64 so as to release the hammer 102 to be driven against the firing pin 114 to extend the distal end thereof against a shell held within the weapon barrel. As stated above, this firing action can only be accomplished when the breech block 14 is fully caged within the receiver 12 such that the trigger pin extension 132 in the breech block 14 is aligned with the trigger pin 134 in the receiver 12.

After the firing, as indicated by the position of elements in FIG. 7, the release 38 on the operating lever 30 is actuated such that the operating lever 30 and lever shaft 32 can be rotated to re-cock the hammer assembly 62 simulataneous with the lateral withdrawal of the breech block 14 from the receiver 12. Near the end of the full rotation of the operating lever 30, which is substantially 180 degrees, the shoulder 82 on the drive link 48 (FIG. 4) engages the ejector operator 50 (FIG. 1) causing the same to rotate such that the ejector (FIG. 2) ejects a spent shell from the barrel of the weapon.

It will be noted that in FIGS. 6 and 7 the breech block 14 is shown to have a chamfered region 92 on a forward-looking corner. This chamfer is provided such that the breech block 14 will move the ejector 28 and the trigger pin 134 aside, to their "ready" positions, such that they are not damaged during movement of the breech block 14 to the fully caged position within the receiver 12.

In a normal operation of the present invention, access to the barrel of a weapon is achieved by rotating the operating lever 30 to the position generally illustrated in FIG. 1. This action uncovers entrance to the barrel of a weapon such that a round of ammunition can be inserted therein. During this insertion, the ejector 28 moves sufficiently such that the tip of the ejector can be seated behind the rim of the round. During the movement of the breech block the hammer assembly 62 is moved to the cocked position (see FIG. 6) by action of the drag link 66 against the hammer cocking pin 80. As stated above, full rotation of the operating lever 30 actuates the ejector operator 50 and ejector 28 to remove any spent shell from the weapon barrel. Reverse rotation of the operating lever 30 to its position engaged with the lever latch 36 returns the breech block 14 to be fully caged within the receiver 12 where it is received in the slideways 22 and 24 of the yoke legs 18 and 20, respectively. In this position, and only in this position, the trigger pin 134 in the receiver 12 and, the trigger pin extension 132 in the breech block 14 are axially aligned such that axial motion of the trigger pin 134 by trigger operation of the weapon will cause firing of the weapon. Further, in this fully caged position the firing pin 114 is exactly aligned with the center of the round to be fired in the weapon.

Disassembly of the components of the breech block 14 is easily accomplished. The operating lever 32, with the lever shaft 32 attached, can be raised upward from the receiver 12 after disengaging any detent engaged with the recess 52 on the lever shaft 32. This permits complete removal of the breech block 14 from the receiver 12 (generally as indicated in FIG. 1). When removed as indicated, the dust cover 56 can be removed by sliding the same in a direction indicated by the arrow 136. This disengages the dust cover 56 from the retention detent 86. In this condition of cover removal, the drive link 48 and the drag link 66 can be removed from the recess 84. When the hammer assembly 62 is uncocked (FIG. 7), by pressing trigger pin extension 132, the hammer cocking pin 80 is removed by upward axial movement (it cannot be removed in the cocked position (FIG. 6) because of a shoulder, not shown.

Various pivot pins, such as the hammer pivot pin 88, the drag link pivot pin 74, and the sear pivot pins 126, 128 are removed by applying axial pressure from beneath the breech block 14 or by turning the breech block upside down and shaking them out. These pins have a slip fit in their holes and are retained in their holes a the bottom by a sub diameter portion (not shown) of the hole and at the top by the dust cover 56. With these pins removed, the hammer assembly 62, the primary sear 64 and secondary sear 118 and the firing pin 114 can be removed from the hammer slot 116. The hammer spring assembly 100 is then removable from its receptor 60. The removal of the components permits replacement of any worn component, or maintenance of the various components, such as lubrication. All of these removal steps, as well as the replacement, are accomplished without tools. Thus, the breech block 14 can be field stripped whenever necessary.

From the foregoing, it will be recognized by persons skilled in the art that an improved firing mechanism has been provided for breech-loaded weapons. This firing mechanism is particularly useful for the weapon of the above-cited patent application No. 08/031,961. The unit is fully field-strippable and, in particular, provides for full safety since the weapon cannot be fired until the breech block 14 is fully caged within the receiver 12. Furthermore, the entire mechanism is extremely compact and small relative to the sizes of the cartridges it is designed to handle. Cocking of the hammer and withdrawal of a spent shell is accomplished by a single action of the operating lever 30 while the breech block 14 is moved to expose entrance to the barrel of the weapon. All components are fabricated from a metal that withstands the pressures of firing, and extended operation of those components. These metals will be known by persons skilled in the art.

The foregoing description with reference to the drawings provides a complete description of a preferred embodiment of the present invention. It will be recognized that the substitution of equivalent components is within the scope of the invention. Accordingly, this description is not for the purpose of limiting the invention. Rather, the invention is to be limited only by the appended claims and their equivalents.

I claim:

1. A firing mechanism for attachment to a barrel of a breech-loading weapon, said weapon having a trigger mechanism, said firing mechanism comprising:

a receiver defined by a central portion having a front face and a rear face and oppositely-disposed first and second leg yoke portions extending from said rear face of said central portion, said central portion defining a receptor for receiving the barrel of the weapon, said first and second leg yokes each provided with a slideway with said slideway of said first leg yoke aligned with said slideway of said second leg yoke;

a trigger release pin extending through said central portion of said receiver from said front face to said rear face and positioned to have a first end in said slideway of said first leg yoke, and a second end at said front face to be engaged by the trigger mechanism of the weapon;

a breech block housing dimensioned for slidable movement within said slideways of said first and second leg yokes from a fully caged position fully inserted in said slideways to a withdrawn position to expose said receptor for the weapon barrel;

a trigger release extension pin mounted within said breech block housing for engagement by said trigger release pin when said breech block housing is fully caged within said slideways of said first and second leg yokes;

a lever shaft pivotally mounted in said central portion of said receiver, said lever shaft having a first end extending from a top surface of said central portion and a second end proximate a bottom surface of said central portion;

an operating lever having a first end attached to said first end of said lever shaft, and a distal end, said operating lever providing for pivotal motion of said lever shaft;

a pivotally-joined linkage assembly within said breech block housing, said linkage assembly having a first end engaged with said lever shaft for pivoting of said linkage assembly during pivotal motion of said lever shaft, and said linkage assembly having a second end engaged with a pivot pin in said breech block housing whereby rotation of said lever shaft causes said linkage assembly to reciprocatively move said breech block housing from said fully caged position within said slideways of said leg yokes to said withdrawn position;

a firing pin mounted in said breech block housing at a location to be aligned with a center of said barrel receptor of said receiver when said breech block housing is in said fully caged position within said slideways;

a hammer assembly mounted within said breech block housing, said hammer assembly including a hammer for engagement against said firing pin when in an uncocked position, said hammer assembly further including a hammer arm pivotally mounted within said breech block housing, a hammer cocking pin carried in said hammer arm, and a hammer spring assembly engaged with said hammer arm to cause said hammer to be engaged against said firing pin, said hammer cocking pin having an extension in contact with said linkage assembly whereby motion of said linkage assembly moves said hammer cocking pin from said uncocked position to a cocked position; and a sear assembly pivotally mounted within said breech block housing, said sear assembly engagable with said hammer to prevent said hammer engagement with said firing pin when said hammer assembly is in said cocked position, and disengagable with said hammer to permit engagement of said hammer against said firing pin during firing of the weapon, said sear assembly further engagable with said trigger release pin extension whereby axial motion of said trigger release pin extension causes rotation of said sear assembly to disengage said sear assembly from said hammer.

2. The firing mechanism of claim 1 wherein said linkage assembly comprises:

a first linkage member having a first end engaged with said lever shaft, and a second end;

a second linkage member having a first end pivotally joined to said second end of said first linkage member, and a second end pivotally joined to said breech block housing.

3. The firing mechanism of claim 1 wherein said sear assembly comprises:

a primary pivotal sear having a shoulder engagable with said hammer to prevent said hammer engagement with said firing pin when said hammer assembly is in a cocked position, and disengagable with said hammer to permit engagement of said hammer against said firing pin during firing of the weapon;

a secondary pivotal sear having a first shoulder engagable with said primary sear when said shoulder of said primary sear is engaged with said hammer, said secondary sear having a second shoulder engaged with said trigger release pin extension whereby axial motion of said trigger release pin extension causes rotation of said secondary sear to disengage said first shoulder of said secondary sear from said primary sear; and a sear spring interposed between said primary and secondary sears to bias said primary sear away from said secondary sear whereby said sear spring rotates said primary sear to cause said shoulder of said primary sear to engage said hammer when said hammer arm is moved to said cocked position by said hammer cocking pin.

4. A firing mechanism for attachment to a barrel of a breech-loading weapon, said weapon having a trigger mechanism, said firing mechanism comprising:

a receiver defined by a central portion having a front face and a rear face and oppositely-disposed first and second leg yoke portions extending from said rear face of said central portion, said central portion defining a receptor for receiving the barrel of the weapon, said first and second leg yokes each provided with a slideway with said slideway of said first leg yoke aligned with said slideway of said second leg yoke;

a trigger release pin extending through said central portion of said receiver from said front face to said rear face and positioned to have a first end in said slideway of said first leg yoke, and a second end at said front face to be engaged by the trigger mechanism of the weapon; slidable movement within said slideways of said first and second leg yokes from a fully caged position fully inserted in said slideways to a withdrawn position to expose said receptor for the weapon barrel;

a trigger release extension pin mounted within said breech block housing for engagement by said trigger release pin when said breech block housing is fully caged within said slideways of said first and second leg yokes;

a lever shaft pivotally mounted in said central portion of said receiver, said lever shaft having a first end extending from a top surface of said central portion and a second end proximate a bottom surface of said central portion;

an operating lever having a first end attached to said first end of said lever shaft, and a distal end, said operating lever providing for pivotal motion of said lever shaft;

first and second linkage members within said breech block housing, said linkage joined to each other with a pivot pin, said first linkage member having a distal end engaged with said lever shaft for pivoting of said first linkage member during pivotal motion of said lever shaft, and said second linkage member having a distal end engaged with a pivot pin anchored in said breech block housing whereby rotation of said lever shaft causes said first and second linkage members to reciprocatively move said breech block housing from said fully caged position within said slideways of said leg yokes to said withdrawn position;

a firing pin mounted in said breech block housing at a location to be aligned with a center of said barrel receptor of said receiver when said breech block housing is in said fully caged position within said slideways;

a hammer assembly mounted within said breech block housing, said hammer assembly including a hammer for engagement against said firing pin when in an uncocked mode, said hammer assembly further including a hammer arm pivotally mounted within said breech block housing, a hammer cocking pin carried in said hammer arm, and a hammer spring assembly engaged with said hammer arm to cause said hammer to be engaged against said firing pin, said hammer cocking pin having an extension in contact with said second linkage member whereby motion of said linkage member moves said hammer cocking pin from an uncocked position to a cocked position;

primary and secondary sear members pivotally mounted within said breech block housing, said primary sear member having a shoulder engagable with said hammer to prevent said hammer engagement with said firing pin when said hammer assembly is in said cocked position, and disengagable with said hammer to permit engagement of said hammer against said firing pin during firing of the weapon, said secondary sear member having a first shoulder engagable with said primary sear member when said shoulder of said primary sear is engaged with said hammer, said secondary sear member having a second shoulder engaged with said trigger release pin extension whereby axial motion of said trigger release pin extension causes rotation of said secondary sear member to disengage said first shoulder of said secondary sear from said primary sear; and a sear spring interposed between said primary and secondary sear members to bias said primary sear member away from said secondary sear member whereby said sear spring rotates said primary sear member to cause said shoulder of said primary sear to engage said hammer when said hammer arm is moved to said cocked position by said hammer cocking pin.

5. The firing mechanism of claim 4 wherein said first and second linkage members are positioned within a top recess of said breech block housing, and further comprising a cover for said top recess, said cover mounted in guides permitting sliding of said cover in said guides to remove and install said cover, said breech block housing having a detent to retain said cover in a closed position to prevent inadvertent removal.

6. The firing mechanism of claim 4 wherein said distal end of said first linkage member is provided with a splined receptor and said level shaft is provided with external splines to be received in said splined receptor whereby rotation of said lever shaft rotates said first linkage member around an axis of said lever shaft.

7. The firing mechanism of claim 4 wherein said lever shaft is provided with an annular recess proximate said distal end, and further comprises a removable restraining member in said central portion of said receiver to engage said annular recess to prevent inadvertent removal of said lever shaft.

8. The firing mechanism of claim 4 wherein said top surface of said central portion of said receiver is provided with a lever latch to engage said distal end of said operating lever, and said operating lever is provided with a release member proximate said distal end to disengage said operating lever from said lever latch.

9. The firing mechanism of claim 4 wherein said distal end of said operating lever is enlarged to facilitate being grasped by a user.

10. The firing mechanism of claim 4 wherein pivot pins of said hammer arm, of said second linkage member, and of said primary and secondary sear members are axially removable from said breech block housing to permit disassembly.

11. The firing mechanism of claim 4 further comprising:

an ejector operator pivotally movable around said lever shaft, said ejector operator having an ejector end projecting into a region of said barrel receptor of said central portion of said receiver to engage a shell inserted into the barrel of the weapon, rotation of said ejector operator causing ejection of the shell; and a shoulder carried by said first linkage member to contact said ejector operator and cause rotation thereof when said operating lever is rotated to a most extended position during movement of said hammer assembly to a cocked position.

12. A firing mechanism for attachment to a barrel of a breech-loading weapon, said weapon having a trigger mechanism, said firing mechanism comprising:

a receiver defined by a central portion having a front face and a rear face and oppositely-disposed first and second leg yoke portions extending from said rear face of said central portion, said central portion defining a receptor for receiving the barrel of the weapon, said first and second leg yokes each provided with a slideway with said slideway of said first leg yoke aligned with said slideway of said second leg yoke;

a trigger release pin extending through said central portion of said receiver from said front face to said rear face and positioned to have a first end in said slideway of said first leg yoke, and a second end at said front face to be engaged by the trigger mechanism of the weapon;

a breech block housing configured for slidable movement within said slideways of said first and second leg yokes from a fully caged position fully inserted in said slideways to a withdrawn position to expose said receptor for the weapon barrel;

a trigger release extension pin mounted within said breech block housing for engagement by said trigger release pin when said breech block housing is fully caged within said slideways of said first and second leg yokes;

a lever shaft pivotally mounted in said central portion of said receiver, said lever shaft having a first end extending from a top surface of said central portion and a second end proximate a bottom surface of said central portion, said lever shaft having external splines on a selected portion between said first end and said second end, said lever shaft further provided with an annular recess proximate said second end;

an operating lever having a first end attached to said first end of said lever shaft, and a distal end, said operating lever providing for pivotal motion of said lever shaft;

first and second linkage members within a top recess of said breech block housing, said linkage joined to each other with a pivot pin, said first linkage member having a distal end provided with a splined receptor to engage said splines of said lever shaft for pivoting of said first linkage member during pivotal motion of said lever shaft, and said second linkage member having a distal end engaged with a pivot pin anchored in said breech block housing whereby rotation of said lever shaft causes said first and second linkage members to move within said recess to reciprocatively move said breech block housing from said fully caged position within said slideways of said leg yokes to said withdrawn position;

a cover member slidably engaged with said breech block housing to cover said recess containing said first and second linkage members, said breech block housing having a spring detect to engage said cover member to prevent inadvertent removal;

a firing pin mounted in said breech block housing at a location to be aligned with a center of said barrel receptor of said receiver when said breech block housing is in said fully caged position within said slideways;

a hammer assembly mounted within a hammer slot in said breech block housing, said hammer assembly including a hammer for engagement against said firing pin when in an uncocked position, said hammer assembly further including a hammer arm pivotally mounted within said breech block housing, a hammer cocking pin carried in said hammer arm, and a hammer spring assembly engaged with said hammer arm to cause said hammer to be engaged against said firing pin, said hammer cocking pin having an extension in contact with said second linkage member, said second linkage member provided with a recess to receive said cocking pin extension, whereby motion of said second linkage member moves said hammer cocking pin from said uncocked position to a cocked position;

primary and secondary sear members pivotally mounted within said hammer slot of said breech block housing, said primary sear member having a shoulder engagable with said hammer to prevent said hammer engagement with said firing pin when said hammer assembly is in said cocked position, and disengagable with said hammer to permit engagement of said hammer against said firing pin during firing of the weapon, said secondary sear member having a first shoulder engagable with said primary sear member when said shoulder of said primary sear is engaged with said hammer, said secondary sear member having a second shoulder engaged with said trigger release pin extension whereby axial motion of said trigger release pin extension causes rotation of said secondary sear member to disengage said first shoulder from said primary sear, and to disengage said shoulder of said primary sear from said hammer; and a sear spring interposed between said primary and secondary sear members to bias said primary sear member away from said secondary sear member whereby said sear spring rotates said primary sear member to cause said shoulder of said primary sear to engage said hammer when said hammer arm is moved to said cocked position by said hammer cocking pin.

13. The firing mechanism of claim 12 wherein said top surface of said central portion of said receiver is provided with a lever latch to engage said distal end of said operating lever, and said operating lever is provided with a release member proximate said distal end to disengage said operating lever from said lever latch.

14. The firing mechanism of claim 12 wherein said distal end of said operating lever is enlarged to facilitate being grasped by a user.

15. The firing mechanism of claim 12 wherein pivot pins of said hammer arm, of said second linkage member, and of said primary and secondary sear members are axially removable from said block housing to permit disassembly.

16. The firing mechanism of claim 12 further comprising:

an ejector operator pivotally movable around said lever shaft, said ejector operator having an ejector end projecting into a region of said barrel receptor of said central portion of said receiver to engage a shell inserted into the barrel of the weapon, rotation of said ejector operator causing ejection of the shell; and a shoulder carried by said first linkage member to contact said ejector operator and cause rotation thereof when said operating lever is rotated to a most extended position during movement of said hammer assembly to said cocked position.

17. A firing mechanism for attachment to a barrel of a breech-loading weapon, said weapon having a trigger mechanism, said firing mechanism comprising:

a receiver defined by a central portion having a front face and a rear face and oppositely-disposed first and second leg yoke portions extending from said rear face of said central portion, said central portion defining a receptor for receiving the barrel of the weapon, said first and second leg yokes each provided with a slideway with said slideway of said first leg yoke aligned with said slideway of said second leg yoke;

a trigger release pin extending through said central portion of said receiver from said front face to said rear face and positioned to have a first end in said slideway of said first leg yoke, and a second end at said front face to be engaged by the trigger mechanism of the weapon;

a breech block housing configured for slidable movement within said slideways of said first and second leg yokes from a fully caged position fully inserted in said slideways to a withdrawn position to expose said receptor for the weapon barrel;

a trigger release extension pin mounted within said breech block housing for engagement by said trigger release pin when said breech block housing is fully caged within said slideways of said first and second leg yokes;

a lever shaft pivotally mounted in said central portion of said receiver, said lever shaft having a first end extending from a top surface of said central portion and a second end proximate a bottom surface of said central portion, said lever shaft having external splines on a selected portion between said first end and said second end, said lever shaft further provided with an annular recess proximate said second end;

an operating lever having a first end attached to said first end of said lever shaft, and an enlarged distal end to be grasped by a user, said operating lever providing for pivotal motion of said lever shaft;

a lever latch positioned in said top surface of said central portion of said receiver to engage said distal end of said operating lever;

a release member proximate said distal end of said operating lever to disengage said operating lever from said lever latch;

first and second linkage members within a top recess of said breech block housing, said linkage joined to each other with a pivot pin, said first linkage member having a distal end provided with a splined receptor to engage said splines of said lever shaft for pivoting of said first linkage member during pivotal motion of said lever shaft, said first linkage having an ejector shoulder, and said second linkage member having a distal end engaged with a pivot pin anchored in said breech block housing whereby rotation of said lever shaft causes said first and second linkage members to move within said recess to reciprocatively move said breech block housing from said fully caged position within said slideways of said leg yokes to said withdrawn position;

a cover member slidably engaged with said breech block housing to cover said recess containing said first and second linkage members, said breech block housing having a spring detent to engage said cover member to prevent inadvertent removal;

a firing pin mounted in said breech block housing at a location to be aligned with a center of said barrel receptor of said receiver when said breech block housing is in said fully caged position within said slideways;

a hammer assembly, mounted within a hammer slot in said breech block housing, said hammer assembly including a hammer for engagement against said firing pin when in an uncocked position, said hammer assembly further including a hammer arm pivotally mounted within said breech block housing, a hammer cocking pin carried in said hammer arm, and a hammer spring assembly engaged with said hammer arm to cause said hammer to be engaged against said firing pin, said hammer cocking pin having an extension in contact with said second linkage member, said second linkage member provided with a recess to receive said cocking pin extension, whereby motion of said second linkage member moves said hammer cocking pin from said uncocked position to said cocked position;

primary and secondary sear members pivotally mounted within said hammer slot of said block housing, said primary sear member having a shoulder engagable with said hammer to prevent said hammer engagement with said firing pin when said hammer assembly is in a cocked position, and disengagable with said hammer to permit engagement of said hammer against said firing pin during firing of the weapon, said secondary sear member having a first shoulder engagable with said primary sear member when said shoulder of said primary sear is engaged with said hammer, said secondary sear member having a second shoulder engaged with said trigger release pin extension whereby axial motion of said trigger release pin extension causes rotation of said secondary sear member to disengage said first shoulder from said primary sear, and to disengage said shoulder of said primary sear from said hammer;

a sear spring interposed between said primary and secondary sear members to bias said primary sear member away from said secondary sear member whereby said sear spring rotates said primary sear member to cause said shoulder of said primary sear to engage said hammer when said hammer arm is moved to said cocked position by said hammer cocking pin; and an ejector operator pivotally movable around said lever shaft, said ejector operator having an ejector end projecting into a region of said barrel receptor of said central portion of said receiver to engage a shell inserted into the barrel of the weapon, rotation of said ejector operator being effected by said ejector shoulder of said first linkage member thereby causing ejection of the shell.

18. The firing mechanism of claim 17 wherein pivot pins of said hammer arm, of said second linkage member, and of said primary and secondary sear members are axially removable from said breech block housing to permit disassembly.

* * * * *